United States Patent [19]

Casbarian et al.

[11] Patent Number: 5,012,875

[45] Date of Patent: May 7, 1991

[54] METHOD AND APPARATUS FOR PROTECTING A SHALLOW-WATER WELL

[75] Inventors: Aramis O. P. Casbarian, Metairie; Kenneth M. Dewalt, Covington, both of La.

[73] Assignee: Barnett & Casbarian, Inc., Metairie, La.

[21] Appl. No.: 154,492

[22] Filed: Feb. 5, 1988

Related U.S. Application Data

[63] Continuation of Ser. No. 936,219, Dec. 1, 1986, abandoned.

[51] Int. Cl.[5] ..... E02B 17/02; E02D 31/00

[52] U.S. Cl. ..... 175/9; 405/195; 405/227; 405/211

[58] Field of Search ..... 175/9; 405/195, 203, 405/211, 216, 227, 201

[56] References Cited

U.S. PATENT DOCUMENTS

| | | | |
|---|---|---|---|
| 3,362,170 | 1/1968 | Manning | 175/9 |
| 3,389,562 | 6/1968 | Mott et al. | 405/227 X |
| 3,483,708 | 12/1969 | Marshall | 175/7 X |
| 3,508,409 | 4/1970 | Cargile | 175/5 X |
| 4,069,683 | 1/1978 | Jansz | 405/228 X |
| 4,084,385 | 4/1978 | Boyadjieff | 405/228 |
| 4,109,476 | 8/1978 | Gracia | 61/87 |
| 4,110,993 | 9/1978 | Heerema | 405/228 |
| 4,228,857 | 10/1980 | Nobileau | 175/7 X |
| 4,269,542 | 5/1981 | Mueller | 405/203 |
| 4,391,332 | 7/1983 | Fayren | 166/350 |
| 4,401,398 | 8/1983 | Remson | 166/367 X |
| 4,422,805 | 12/1983 | Sweatman | 405/227 |
| 4,437,791 | 3/1984 | Reynolds | 405/195 |
| 4,558,973 | 12/1985 | Blandford | 405/227 |
| 4,592,422 | 6/1986 | Hipp | 166/96 |

FOREIGN PATENT DOCUMENTS

| | | | |
|---|---|---|---|
| 019808 | 2/1985 | Japan | 405/228 |
| 208513 | 10/1985 | Japan | 405/227 |
| 8401934 | 1/1986 | Netherlands | 405/227 |
| 628232 | 10/1978 | U.S.S.R. | 407/227 |
| 1563107 | 3/1980 | United Kingdom | 405/227 |
| 2153886 | 8/1985 | United Kingdom | 405/227 |

*Primary Examiner*—Bruce M. Kisliuk

[57] ABSTRACT

A method and apparatus for protecting an isolated well conductor of a shallow-water well by positioning a reinforcing frame with pile sleeves next to the well conductor near the water surface and driving piles through the pile sleeves into the ocean floor, and subsequently connecting the pile sleeves to the piles and the frame to the well conductor above the water surface.

27 Claims, 3 Drawing Sheets

FIG. 4
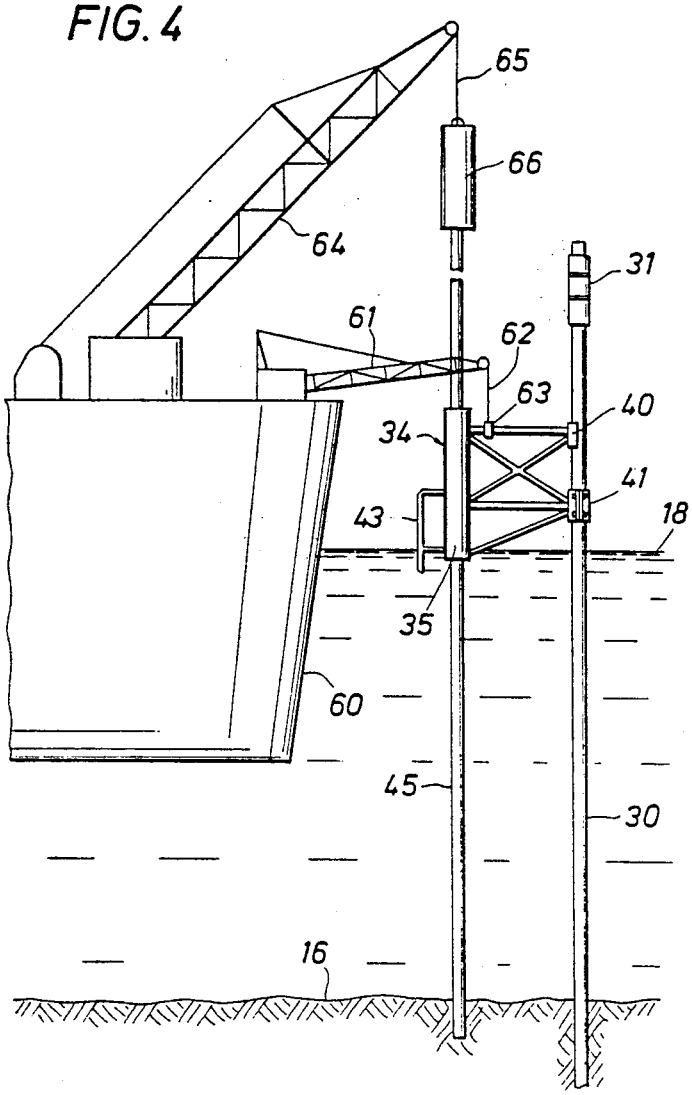
FIG. 6
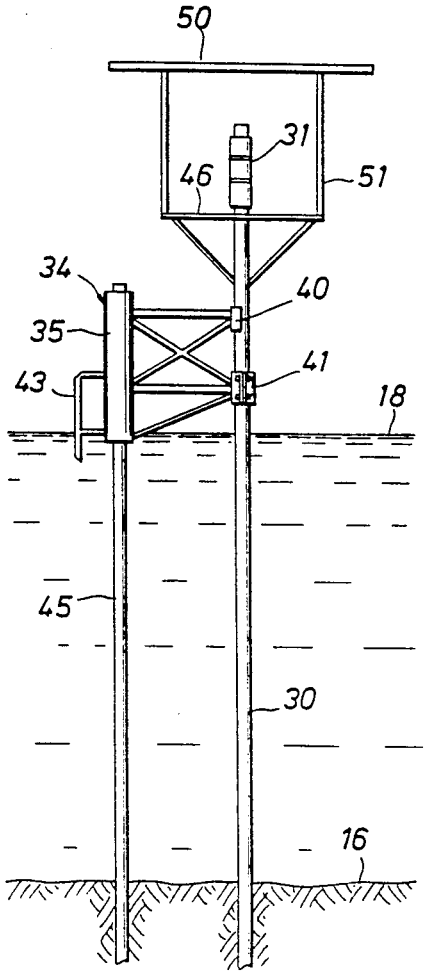
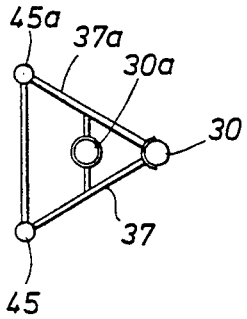
FIG. 9
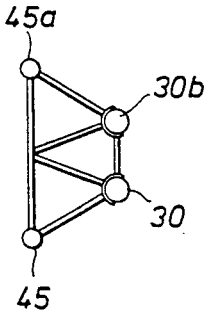
FIG. 10
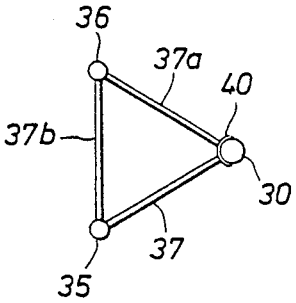
FIG. 5

METHOD AND APPARATUS FOR PROTECTING A SHALLOW-WATER WELL

This is a continuation of application Ser. No. 936,219, filed Dec. 1, 1986 now abandoned.

This invention relates to a method and apparatus for protecting the well conductor of a shallow water well which may be drilled from a jack-up rig in locations where only a few wells are to be drilled.

BACKGROUND OF THE INVENTION

From time to time, offshore structures in the form of large offshore platforms are erected on the ocean floor for the purpose of drilling a large number of wells into the ocean floor in order to develop and oil or gas fields. In shallow water locations where small amounts of oil and gas have been found, the erection of a large platform could not be economically justified. Thus, at times, only a single well need be drilled down to the oil deposit. Alternatively, single wells are often drilled in extensions of known fields to develop small deposits. At other times, it is often desired to drill a single well and evaluate the field production for a year prior to going forward with further drilling of that area.

In shallow water of, say, 50 feet in depth, a single well would be drilled by driving a large diameter drive pipe or well conductor into the ocean floor. The well conductor, which may be 48 inches in diameter, forms the outer tubular member of a well installation. A well is drilled through the well conductor in a manner well known to the art and then is closed at the top by a well head assembly of the type used in producing a well. A single well of this type is normally protected by fabricating onshore a well protector jacket which is normally square in cross-section and extends for a height equal to the distance between the ocean floor and the wellhead at the top of the well conductor. Such a jacket is transported by barge or otherwise to the offshore location where a derrick barge is employed to lift the jacket above the wellhead and slip it down over the wellhead and well conductor to the ocean floor. Piles are then driven down through the corner legs of the jacket to anchor it to the ocean floor.

SUMMARY OF THE INVENTION

The present invention is directed to apparatus for reinforcing shallow water wells and a method for installing the apparatus at an offshore location. The present apparatus includes simple structural components that require a minimum of labor offshore in connecting the apparatus to a well conductor. The apparatus is designed so that connections are made only above the water line to facilitate the assemblage of the apparatus.

It is an object of the present invention to provide an apparatus to be connected to a well conductor to aid the conductor in resisting the forces of wind and waves to which it is subjected.

It is a primary object of the present invention to provide a method of drilling a shallow water offshore well and reinforcing the well structure from a work barge or other vessel having a crane and associated hoisting systems thereon. The method contemplates employing a jack-up drilling platform for driving the well conductor and drilling the well through the conductor. Subsequent reinforcing of the well conductor with the apparatus of the present invention and driving piles through the reinforcing apparatus is carried out from a work barge or other vessel positioned near the well conductor. The jack-up platform is provided with a drilling rig or derrick which may be moveable laterally on its base platform or operating platform so that the derrick may be moved to an operative position which is outboard of the elevated operating platform. A jack-up platform having its derrick on a cantilevered section of the platform may be employed or, alternatively, a jack-up rig having a drilling slot in the platform extending inwardly from the outer edge thereof, may be used. Thus, in either case a jack-up platform may be employed which is of a design that provides for the derrick to be moved laterally on the platform within a prescribed work area so that the center line of the derrick, and thus its hoist system, is positioned over open water to one side or outboard of the platform, or over the slot therein if one is present.

The jack-up drilling platform is located at a selected shallow water drilling location and its leg footings are set on the ocean floor while subsequently the operating deck is jacked up to the normal operating position above the water surface and wave action. By use of the hoist system of the derrick, a large diameter well conductor, say, 48 inches in diameter, is lowered through the water below the derrick and set into the ocean floor. Generally, the well conductor is driven into the ocean floor by means of a pile driver to refusal. A well is drilled through the well conductor from the jack-up platform and the top of the well conductor is closed by means of a conventional wellhead.

In order to reinforce the finished well installation, a relatively small reinforcing frame, which has been previously fabricated onshore, is transported by a work barge or other vessel to the well conductor where one corner of the frame is positioned against the well conductor. At least two other corners of the reinforcing frame are provided with vertical pile guide sleeves of 10 feet or more in length through which piles may be driven into the ocean floor. With the reinforcing frame supported against the well conductor, as by means of a crane on the work barge, the hoist system of another crane on the work barge then picks up from 40 to 80 feet of pile and lowers it through the pile guide sleeve and, by means of a pile driver connected to the upper end of the pile, drives it into the ocean floor. Additional lengths of pile are welded to the upper end of the driven pile in a manner well known to the art. After the piles have been driven to the selected depths, they are connected to the reinforcing frame in any suitable manner. The frame is also connected to the well conductor either before or after the piles are driven.

By employing the method and apparatus of the present invention, well conductors of thinner walled pipe may be satisfactorily employed when reinforced in accordance with this invention. Additionally, single well conductors may be used in deeper waters with satisfactory results when protected in the present manner.

BRIEF DESCRIPTION OF THE DRAWING

These and other objects of the present invention will appear hereinafter from a consideration of the drawing and description.

FIG. 4 is a diagrammatic view of a work barge installing pile through a reinforcing frame positioned against a well conductor;

FIG. 5 is a plan view of the frame of FIG. 4;

FIG. 6 is a partial side elevation view diagrammatically illustrating the final stage of the field installation of the reinforcing apparatus of the present invention being positioned and connected to the well conductor;

FIGS. 9 and 10 are plan views illustrating various arrangements of the reinforcing apparatus of the present invention when used on one or two wells.

DESCRIPTION OF A PREFERRED EMBODIMENT

Figure 1:
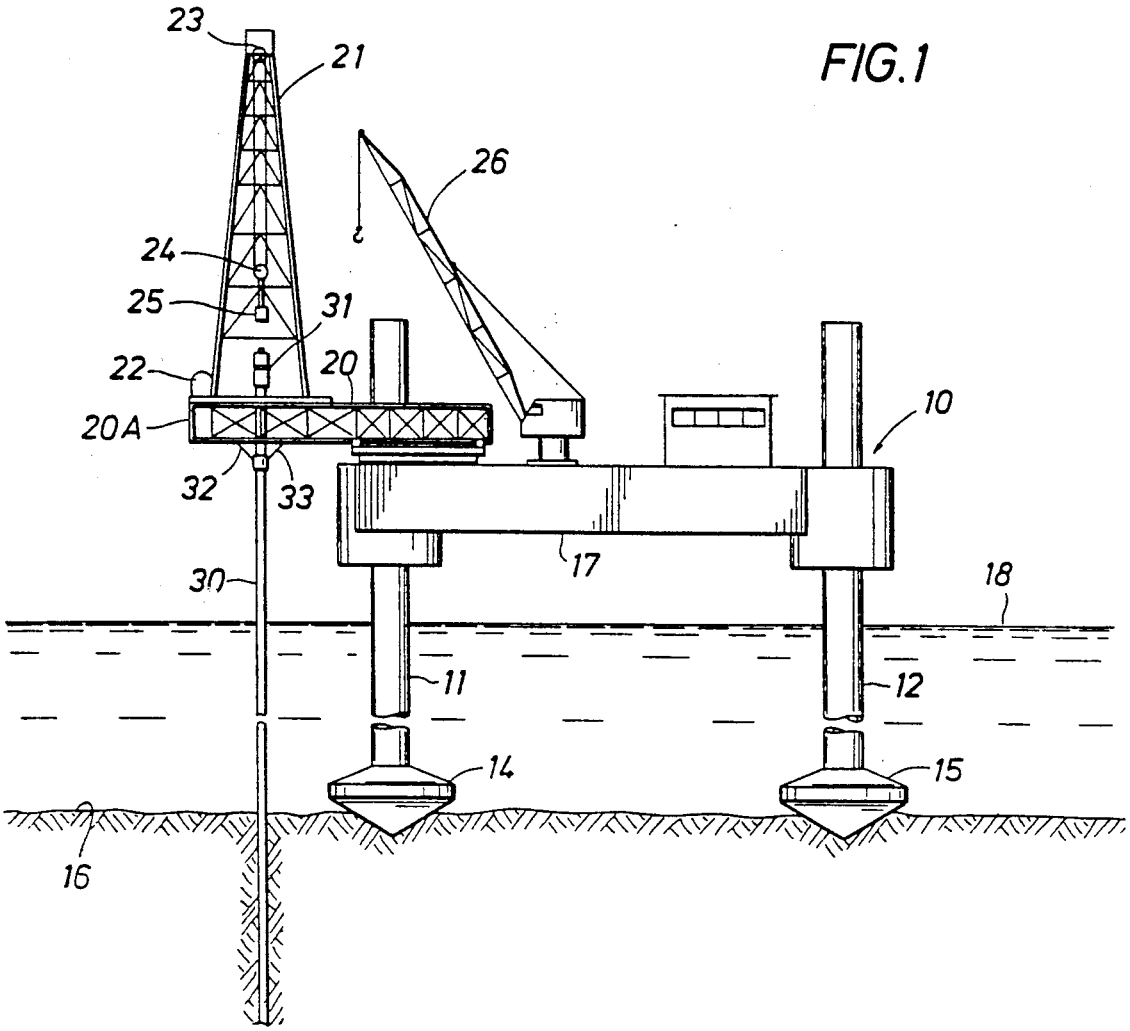
FIG. 1 is a side elevation view of a jack-up platform drilling a well in the ocean floor.

Referring to FIG. 1 of the drawing, an offshore jack-up platform or rig 10 is illustrated as being positioned at a drilling location offshore. Two of its three legs 11 and 12 are shown as having been jacked down so that the footings 14 and 15 at the lower end thereof rest on the ocean floor 16 with the operating platform 17 of the jack-up rig having been elevated above the ocean surface 18. In this case the jack-up rig 10 is provided with a cantilevered section of the operating deck 20 which extends outboard of the main deck section 17. A drilling derrick 21 is mounted on the cantilevered section 20A. The derrick 21 is provided with a normal hoist system comprising a hoist 22, crown block 23, travelling block 24, and elevators 25 or other connection means for connecting and lowering pipe into a well. A crane 26 is shown as positioned on the deck of the platform to aid in carrying out operations.

Figure 2:
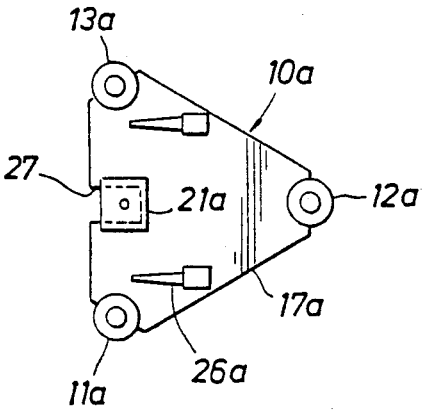
FIG. 2 is a plan view of another type of a jack-up platform having a slot in the operating platform.

In FIG. 2, another form of jack-up platform is shown as having legs 11A, 12A and 13A at the three corners of the triangular-shaped hull which may form the operating deck of the platform 10*a*. The operating deck 17*a* is shown as being provided with a slot 27 which extends inwardly from the outer edge of the deck or hull 17*a* a distance of, say, 35 or 40 feet. The width of the slot 27 is generally about 25 feet. The derrick 21*a* is shown as spanning the slot 27 and is moveable along the length and across the width of the slot as desired. Thus, with the platform located in its drilling position as shown in FIG. 1, the derrick can be moved laterally relative to the outer edge of the operating deck to any selected drilling location.

In FIG. 1 a well has been drilled through a well conductor 30 and is diagrammatically shown as being closed by a wellhead assembly 31. During drilling operations the well conductor may be supported in any suitable manner from the operating deck 20 as by means of cables 32 and 33. The platform of FIG. 2 may be provided with one or more cranes 26*a*.

Figure 3:
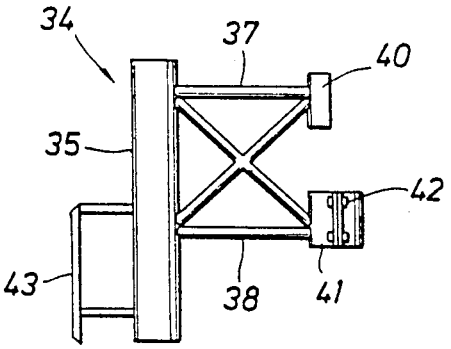
FIG. 3 is a side elevation view of one form of a reinforcing frame in accordance with the present invention.

One form of reinforcing frame or structure to be used to reinforce an unsupported well conductor in shallow water may take the form of a pile guide template frame 34. The pile guide template frame 34 comprises at least two normally vertically-extending open ended tubular pile guide sleeves 35 and 36 (FIG. 8) of, say, an internal diameter of 40 inches so as to pass a 36-inch diameter pile therethrough. The frame 34 in FIG. 3 is shown as being provided with laterally-extending support members 37 and 38 which terminate in suitable connector means 40 and 41 which are preferably configured on their inner surface to fit against or around a well conductor, as desired. The connector plate 40 is of the type that may be welded directly against the outside surface of the well conductor above the water line in order to support the pile guide frame 34 in place prior or subsequent to driving piles therethrough. The connector 41 shown at the end of the lower arm 38 is illustrated as being of the split collar type which would be connected to a well conductor by means of bolts 42. In the event that boats are used to transfer personnel to a well installation to inspect it, the pile guide frame 34 is provided with a boat landing and bumper 43. The connectors 40 and 41 are positioned at a selected distance from each pile guide sleeve 35 and 36 (FIG. 11), which distance is determined by engineering considerations.

In FIG. 4, the pile driving operation of the method of the present invention is illustrated as being carried out from a work barge 60, or any other suitable vessel equipped for pile driving which may float, or sit on the ocean floor. The barge 60 is provided with a crane 61 or other suitable equipment, having a hoist cable 62 and hook 63, for temporarily supporting the frame 34 above the water surface and against the well conductor 30 prior to affixing the connectors 40 and 41 to the well conductor 30 and/or driving pile 45 through guide sleeve 35. The work barge 60 is also provided with a hoisting crane 64 having a hoist cable 65 secured to the upper end of a suitable pile driver or hammer 66 which is adapted to engage or be operatively connected to a pile 45 to be driven.

In FIG. 4 the pile guide template frame 34 of FIG. 3 has been transported in any suitable manner, as by barge 60, out to the unsupported well conductor 30 where it is picked up by any suitable hoist means 61 on the work barge 60 and positioned so that the connectors 40 and/or 41 (FIG. 3) are positioned against the well conductor 30 where they may be connected either before or after the pile driving operation. The frame 34 may be hung off the barge 60 at the desired level against the well conductor 30 with the boat landing 43 at water level.

With the pile guide frame in place, the crane 64 is moved until its hoist cable 65 is positioned directly over one of the pile guide sleeves 35 or 36. Lengths of pile are then picked up one at a time and lowered down through the sleeve 35. Additional lengths of pile are welded to the upper end of the pile section being lowered in a manner well known to the art and the pile is driven into the ocean floor, as by means of a pile driver 66 in a manner well known to the art. The pile, when driven in place, is illustrated at 45 in FIG. 6. A follower pile may be used, if desired.

The crane 64 is then moved to a position over the other spaced-apart pile sleeve 36 (FIG. 7) and the operation of picking up piles, lowering them through the pile sleeve 36 and driving them into the ocean floor is repeated. Each of the piles 45 is fixedly secured to the surrounding pile sleeve in any manner well known to the art. For example, the top of each pile may be connected to its surrounding sleeve by means of welding to spacers or shims. Additionally and/or alternatively, the annular space formed between each pile and its surrounding sleeve is filled with cement grout in a manner well known to the art.

Figure 7:
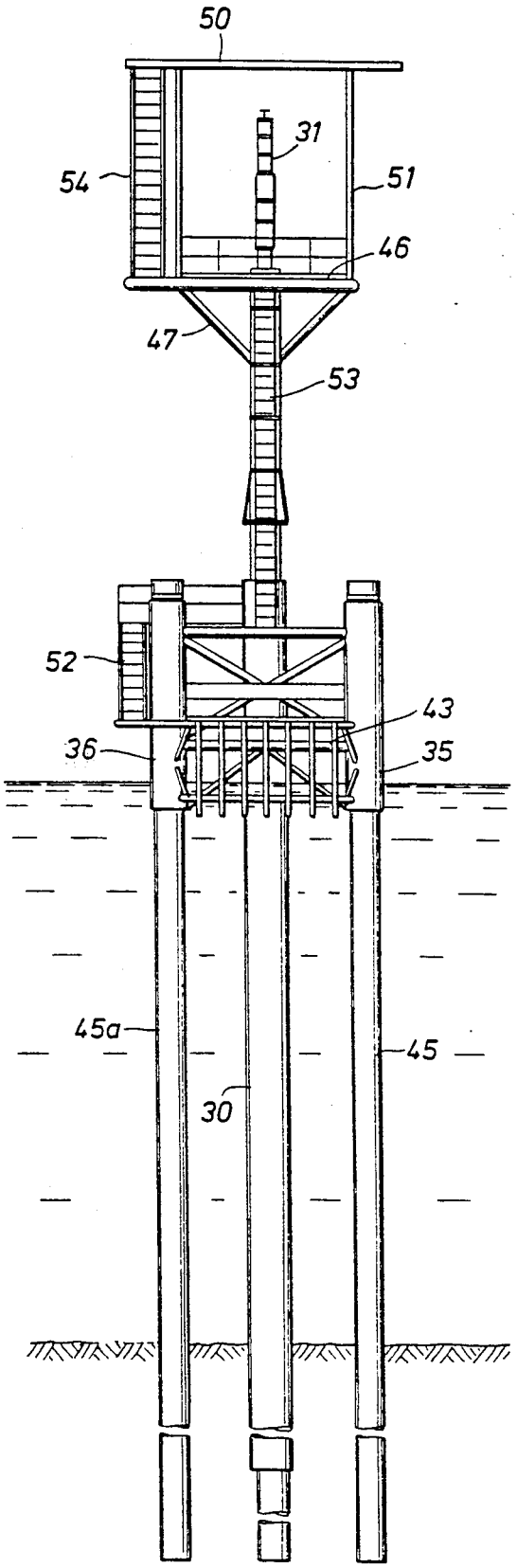
FIGS. 7 and 8 are side and front elevation views of a typical reinforced shallow water well.
Figure 8:
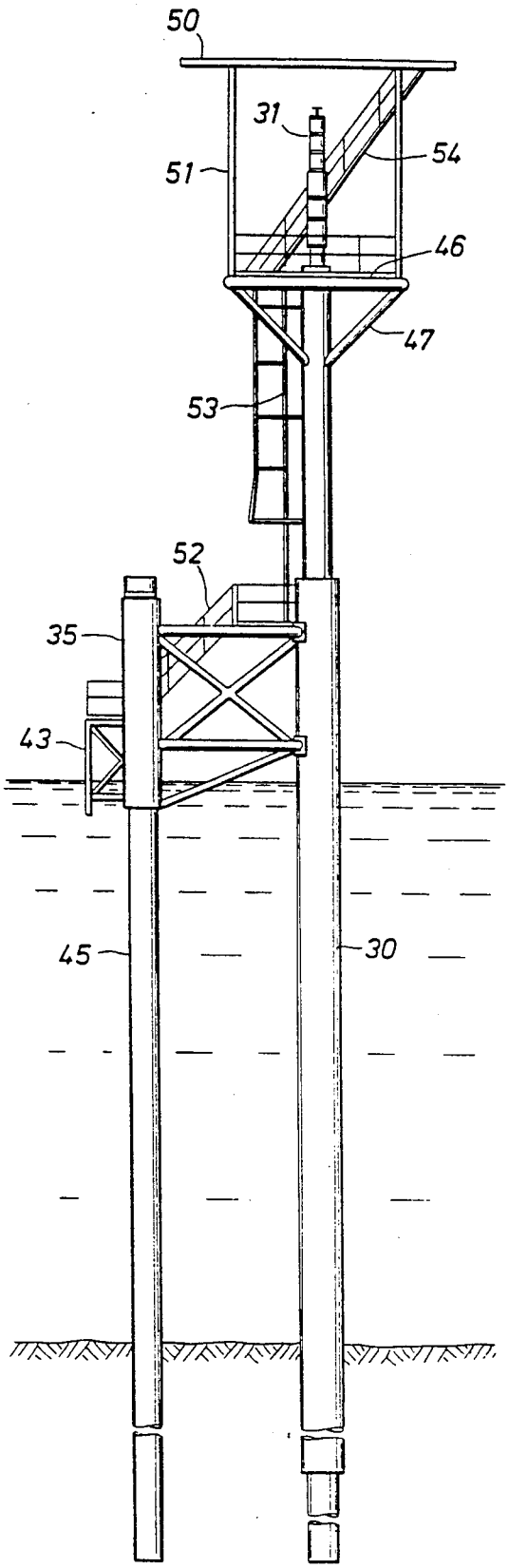

Subsequently, an operating platform 46 may be mounted and affixed to the top of the piles 45 and 45*a* and/or to the well conductor 30 below the wellhead assembly to allow personnel or maintenance men to inspect or maintain the well. If desired, a helicopter pad 50, as illustrated in FIG. 6, 7 and 8, may be mounted above the wellhead assembly 31 by means of a suitable support assembly or frame 51 which in turn is secured to the structure, that is, either to the top of the piles 45 and 45*a* or to the operating platform 46 and thence to the wellhead conductor 30. Suitable stairways or ladders 52, 53 and 54 can be provided so that personnel can move from the boat landing 43 or helicopter pad 50 to the operating platform 46. The platform 46, framing 51 and heliport 50 may be constructed onshore and installed as a complete unit.

In FIGS. 9 and 10 pile sleeve support frame configurations are shown which provide for two wells 30 and 30*a* in FIG. 9 with well 30A being separately supported to the support members 37 and 37*a* by additional cross bracing members. It is to be noted that well 30*a* falls within the periphery of the triangle formed between the piles 45 and 45*a* and the well 30. In FIG. 10, the wells 30 and 30*b* are on the periphery of the polygonal configuration of the reinforcing frame.

We claim as our invention:

1. A method of drilling a shallow-water offshore well from a drilling barge and subsequently reinforcing an unsupported columnar well installation to resist the effect of wind and wave forces encountered by said well installation, said method comprising the steps of:

(a) installing a well conductor in the ocean floor at a shallow water location and anchoring it to the ocean floor, (b) drilling a well through said well conductor and closing the top of the well with a production wellhead, thereby forming an unsupported columnar well installation of an offshore unsupported well conductor, (c) providing a pile guide template frame comprising at least two spaced-apart pile guides connected together by laterally-extending support members with additional laterally-extending support members arranged to extend between and be connected at one end to each of the pile guides and at the other end to the well conductor when positioned thereagainst, with the pile guides being at a selected distance from the well conductor, (d) transporting the pile guide template frame to the offshore unsupported well conductor, (e) positioning said frame in a manner such that the other ends of the additional laterally-extending support members are operatively positioned adjacent a wall of said well conductor, said position being such that at least said other ends of said additional laterally-extending support members at the top of the frame are above the surface of the water, (f) lowering a pile through each of said pile guides of said frame and driving said pile into the ocean floor, and (g) forming an interconnected reinforcing structure by suspending the pile guide template frame above the ocean floor upon the piles and the well conductor, said step of forming the interconnected reinforcing structure comprising:

(1) fixedly connecting each pile to its surrounding pile guide, and (2) operatively connecting at least said other ends of said laterally-extending support members at the top of the frame to the well conductor, whereby said frame forms the interconnecting reinforcing structure between the piles and the well conductor to resist the effect of wind and wave forces encountered by said well conductor.

2. The method of claim 1 including the steps of providing a work platform at the base of said wellhead, and fixedly securing said work platform to at least said well conductor.

3. The method of claim 2 including the steps of providing a helicopter pad and a depending support frame, and fixedly securing said helicopter pad support frame to at least said work platform.

4. The method of claim 1 wherein the operation carried out in step g(2) is accomplished by providing a sliding connection permitting limited movement between the well conductor and the reinforcing frame.

5. The method of claim 1 wherein in step (e) the frame is positioned by hanging it from a crane of a work barge positioned nearby.

6. The method of claim 1 including the steps of providing a work barge having a pair of positionable hoisting cranes thereon, and positioning the work barge adjacent the well conductor and within the working area of the barge cranes.

7. The method of claim 6 wherein step (e) of claim 1 is carried out by temporarily connecting the pile guide frame to the hook of one crane and moving the crane to suspend the frame against the well conductor during the pile driving operation of step (f).

8. The method of claim 6 including the step of utilizing a second crane on the work barge to suspend a length of pile and a pile driver operatively connected thereto above one of the pile guides of the frame prior to driving the pile through the pile guide.

9. The method of claim 1 wherein the step of connecting the pile guide frame to the well conductor is carried out after the pile driving operation.

10. The method of claim 9 wherein the step of connecting the pile guide frame to the well conductor is carried out by welding.

11. The method of claim 1 wherein the step of connecting the pile guide frame to the well conductor is carried out before the pile driving operation.

12. The method of claim 1 wherein each of said piles is connected to its surrounding pile guide by grouting.

13. A method in accordance with claim 1 wherein the spaced-apart pile guides are substantially vertical and receive substantially vertical piles therethrough.

14. A method in accordance with claim 1 wherein the laterally-extending support members are substantially horizontal.

15. Apparatus adapted for field reinforcement of an unsupported offshore shallow-water well having a large-diameter well conductor anchored in the ocean floor and extending upwardly in an unsupported and unbraced manner to terminate at a selected height above the wave action where it is closed by a production wellhead, said apparatus forming a pile guide template frame comprising:

(a) at least two spaced apart, open-ended tubular pile guide sleeves of an internal diameter to pass therethrough and position therein a large-diameter offshore pile, (b) laterally-extending support members of selected length extending between the spaced-apart pile guide sleeves and affixed thereto, and extending a selected distance from each pile guide sleeve to terminate adjacent each other at a point above the water surface and against an unsupported well conductor when installed thereagainst, whereby, when taken in plan view, the arrangement of said pile guide template frame and said sleeves forms a substantially polygonal configuration when taken with and placed in contact with an unsupported well conductor, and (c) means for suspending the pile guide template frame above the ocean floor, comprising:

(1) means for connecting the free ends of said outwardly-extending support members to the well conductor, and (2) means for connecting the pile guide sleeves to the piles.

16. An apparatus in accordance with claim 15 wherein the spaced-apart pile guides are substantially vertical to receive substantially vertical piles therethrough.

17. An apparatus in accordance with claim 15 wherein the laterally-extending support members are substantially horizontal.

18. An isolated offshore well installation comprising:

(a) an unsupported well conductor installed in the ocean floor and having a well drilled therethrough and closed at the upper end above the wave height by a production wellhead assembly, (b) a pile guide template frame and laterally-extending support members fixedly secured at least above the water line to the outer surface of the well conductor below the wellhead assembly and extending outwardly to at least one side of said conductor, (c) said frame at a selected distance from the well conductor being provided with at least two spaced-apart open-ended and vertically-positioned tubular rigid pile sleeves at least 10 feet in height and extending at least 10 feet upwardly from the water surface, (d) A large-diameter pile extending through each of the spaced-apart pile sleeves with the lower end of each pile being anchored in the ocean floor and (e) means fixedly securing each pile within its surrounding sleeve and, together with the well conductor, supporting the frame above the ocean floor.

19. The apparatus of claim 18 wherein the means (e) comprises steel shims welded to each pile and its surrounding sleeve near the top thereof and cement grout filling the annular space formed between each pile and its surrounding pile sleeve.

20. The apparatus of claim 18 wherein the pile sleeves also extend downwardly from 5 to 40 feet into water that is at least twice as deep.

21. The apparatus of claim 18 including a work platform position adjacent said wellhead assembly and support means fixedly securing said work platform to at least the well conductor.

22. The apparatus of claim 21 including a second well conductor connected to the frame and anchored in the ocean floor.

23. The apparatus of claim 22 wherein said second well conductor is positioned on the periphery of the polygonal configured frame.

24. The apparatus of claim 22 wherein said second well conductor is positioned within the periphery of said polygonal configured frame and including additional lateral support members connecting the second well conductor to the frame.

25. The apparatus of claim 22 wherein said second well conductor is positioned outside the periphery of said polygonal configured frame and including additional lateral support members connecting the second well conductor to the frame.

26. The apparatus of claim 18 including a helicopter pad positioned over said wellhead assembly, and support means fixedly securing said helicopter pad to at least the well conductor.

27. The apparatus of claim 18 wherein the laterally-extending support members of said frame together with said pile sleeves and well conductor, when taken in plan view, are arranged in a polygonal configuration with the pile sleeves and the well conductor positioned on the periphery thereof.

* * * * *